US008205314B1

(12) United States Patent
Dermody, IV

(10) Patent No.: US 8,205,314 B1
(45) Date of Patent: Jun. 26, 2012

(54) REVERSIBLE CABLE COVERING FOR USE IN CHROMA KEY VIDEOGRAPHY

(76) Inventor: William E. Dermody, IV, Sparta, NJ (US)

( * ) Notice: Subject to any disclaimer, the term of this patent is extended or adjusted under 35 U.S.C. 154(b) by 730 days.

(21) Appl. No.: 12/364,576

(22) Filed: Feb. 3, 2009

(51) Int. Cl.
*B21D 39/00* (2006.01)

(52) U.S. Cl. ..... 29/428; 29/458; 382/163

(58) Field of Classification Search ..... 29/428, 29/458; 138/123, 128, 110; 57/3, 31; 428/99, 428/100; 382/163
See application file for complete search history.

(56) References Cited

U.S. PATENT DOCUMENTS 5,240,758 A * 8/1993 Honigberg ..... 428/100
5,535,787 A * 7/1996 Howell ..... 138/167
2003/0211263 A1 * 11/2003 Dermody et al. ..... 428/36.3

* cited by examiner

*Primary Examiner* — Jermie Cozart
(74) *Attorney, Agent, or Firm* — LaMorte & Associates, P.C.

(57) ABSTRACT

A method for providing a colored mask for a cable, wire or rope that can be quickly changed between two colors. A sheath covering is provided for a flexible element, such as a cable. The sheath covering has a length, a first side, an opposite second side, and two side edges. The first side of the sheath covering is pigmented in a first key color. Conversely, the second side of each sheath covering is pigmented in a second key color. The sheath covering is formed into a tubular structure around the flexible element. Depending upon which way the sheath covering is curved, either the first side or the second side can become the visible exterior of the tubular structure. Accordingly, to mask a flexible element in a first color, the sheathing covering is positioned around the flexible element. To change the color, the sheathing covering is merely inverted.

10 Claims, 2 Drawing Sheets

REVERSIBLE CABLE COVERING FOR USE IN CHROMA KEY VIDEOGRAPHY

BACKGROUND OF THE INVENTION

1. Field of the Invention

In general, the present invention relates to protective sheath covers for wires, cables and the like. More particularly, the present invention relates to cable sheath covers that have closable seams that run the length of the sheath cover.

2. Prior Art Description

In digital videography, it is often desirable to add computer generated imagery to the actual image being recorded. The computer generated imagery may be used to add something to the recording that is not there or to remove something from the recording that is there. For example, during a television news network, computer generated imagery is commonly used to produce the maps behind a weather reporter. Likewise, computer generated imagery is also used to remove the sight of safety cables that may be attached to an actor during an action stunt scene.

In order to add or remove objects from actual recording, chroma key videography techniques are used. Chroma key videography is also known in the industry as color keying, color separation overlay, blue screening or green screening. In chroma key videography, objects viewed by the camera that are to be replaced with computer generated imagery are masked in a specific color, which is typically blue or green. Blue and green are most often used because they are the colors most distinguishable from human skin tones.

An actual image is recorded where the undesired objects are uniformly colored. The selected color is called the "keyed color". The recorded image is processed by a computer program. If the computer detects the keyed color in a recorded frame, the computer identifies the pixels containing the keyed color and leaves those pixels blank. The computer then substitutes corresponding pixels from a computer generated image. The result is that the real image and the computer generated image are superimposed where the computer generated image takes the place of anything in the frame that is masked in the keyed color.

There are many complications that occur from using chroma key videography. For example, if a weather reporter is to stand before a blue screen, that reporter cannot be wearing blue clothing or have blue eyes otherwise these areas will be replaced by sections of the computer generated map when viewed onscreen. The problem becomes much more complex when filming movies or television shows where dozens of actors and hundreds of different objects may come in and out of a scene.

In order to minimize difficulties, many studios have both blue screen backgrounds and green screen backgrounds. The studios change the backgrounds depending upon the requirements of a scene. If objects to be recorded contain green, such as a bouquet of flowers, a blue screen background is used. Likewise, if objects containing blue are to be recorded, such as an actor in a blue shirt, then a green screen is used.

In a studio, it is relatively easy to change a backdrop from green to blue and vice versa. What is much harder is changing coverings on the numerous cables, wires, power cords, ropes and tethers that are abundant on a studio set.

The present invention is a uniquely formed cable sheathing device that can be used to cover any elongated object such as a cable, wire or rope. The cable sheathing device is reversible. One side of the sheath covering is green. The opposite side is blue. This enables objects such as cables and wires to be quickly and efficiently changed in color between blue and green so that they can match the changing background for a scene being recorded with a chroma key videography technique. The details of the present invention are described and claimed below.

SUMMARY OF THE INVENTION

Many studios record scenes on a set using chroma key videography. It is also common to change from one mask key color to another depending upon the color schemes of the objects in a scene. Backgrounds can be quickly changed. However, the changing of colored maskings on cables, ropes and wires takes a great deal of labor and time.

The present invention is a method for providing a colored mask for a cable, wire or rope that can be quickly changed between two colors using a minimum of labor and time.

In accordance with the present invention method, a sheath covering is provided for a flexible element, such as a cable. The sheath covering has a length, a first side, an opposite second side, and two side edges. The first side of the sheath covering is pigmented in a first key color. Likewise, the second side of the sheath covering is pigmented in a second key color.

The sheath covering is formed into a tubular structure around the flexible element. Depending upon which way the sheath covering is curved, either the first side or the second side can become the visible exterior of the tubular structure. Accordingly, to mask a flexible element in a first color, the sheathing covering is positioned around the flexible element. To change the color, the sheathing covering is merely reversed. Two different masking colors can therefore be obtained using a single sheath covering.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention cable sheathing device can be made in many sizes and lengths, only a short segment of the sheathing device is illustrated. A short section is selected for simplicity and should not be considered a limitation when interpreting the scope of the claims.

Figure 1:
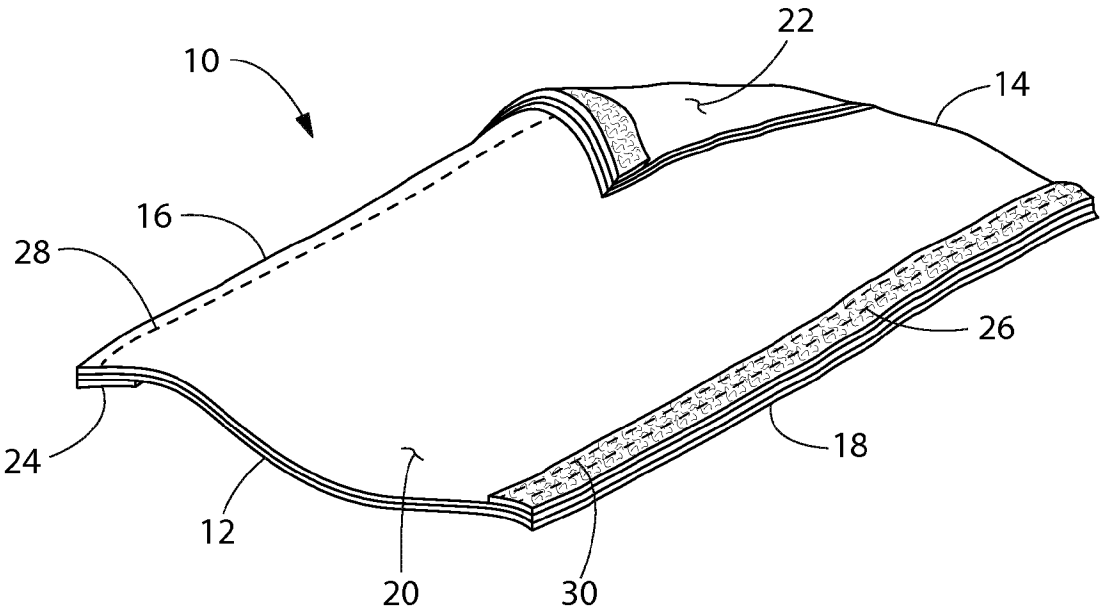
FIG. 1 is a perspective view of an exemplary embodiment of an sheath covering in an open condition.
Figure 2:
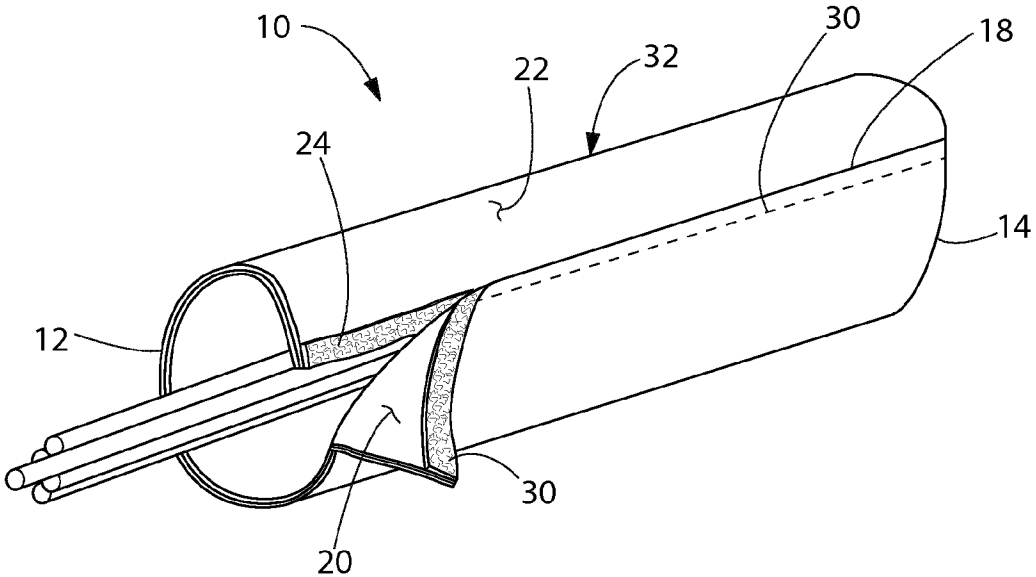
FIG. 2 is a perspective view of the sheath covering of FIG. 1 wrapped around a section of cable.

Referring to FIG. 1 and FIG. 2, a sheathing device 10 is shown. The sheathing device 10 as a first end 12 and an opposite second end 14. The length between the first end 12 and the second end 14 may be as short as a few inches or as long as several yards, depending upon a given application. The sheathing device 10 has two side edges 16, 18 that run between the first end 12 and the second end 14.

The sheathing device 10 is made of two layers of material that are laid atop each other. A first layer 20 of material is a first color. The second layer 22 of material is a second color. The preferred colors for the first layer 20 and the second layer 22 are green and blue to match the two most common masking colors used in chroma key videography. However, other colors such as magenta have also been known to be used.

Both the first layer 20 of material and the second layer 22 of material are woven synthetic fibers, such as polyester, that are woven with a thread count or density sufficient to ensure that each layer of material is opaque. That is, the color of a cable surrounded by the sheathing device 10 cannot be visually ascertained. Furthermore, the fibers in both layers 20, 22 of material are treated to have a flat or low-gloss luster. In this manner, the material does not accidentally reflect light or create glare even under the intense lighting of a studio environment. It is also preferred that both layers 20, 22 of material be chemically treated with a flame retardant. This is to reduce the risk of fire to any segment of the sheathing device 10 that may inadvertently come into contact with hot lighting fixture or a spark from a pyrotechnic special effect.

Two opposing lengths 24, 26 of hook and loop fastening material are sewn onto the sheathing device 10. Each length 24, 26 of hook and loop material runs the length of the sheathing device 10 from the first end 12 to the second end 14. The first length 24 of hook and loop material is sewn to the first layer 20 of material along the first side edge 16 of the sheathing device 10. The first length 24 of hook and loop material is sewn with seams 28 that pass directly through both the first layer 20 of material and the second layer 22 of material. Accordingly, the seams 28 join together the first length 24 of hook and loop material as well as both the first and second layers 20, 22 of material.

Conversely, the second length 26 of hook and loop material is sewn onto the second layer 22 of material along the second side edge 18 of the sheathing device 10. The second length 26 of hook and loop material is also sewn with seams 30 that pass directly through both the first layer 20 of material and the second layer 22 of material.

It will therefore be understood that the two lengths 24, 26 of hook and loop material are sewn onto opposite sides of the sheathing device 10 and along opposite side edges 16, 18 of the sheathing device 10. Accordingly, the only way the two lengths 24, 26 of hook and loop material can be interconnected along their full lengths is to curve the sheathing device 10 into a tubular structure 32.

The tubular structure 32 can be created in one of two ways. First, the first layer 20 of material can be on the exterior of the tubular structure 32. Second, the second layer 22 of material can be on the exterior of the tubular structure 32. In either configuration, the physical structure of the tubular structure 32 is identical. Only, the exterior color of the sheathing device 10 is different in the two configurations.

To utilize the present invention, a segment of cable is identified that may be in the field of view of a camera. A segment of the sheathing device 10 is obtained that is long enough to cover the cable. Depending upon the key color selected for the chroma key videography, the sheathing device 10 is oriented with either the first layer 20 of material or the second layer 22 of material on its exterior. The sheathing device 10 is then shaped into a tubular structure 32 by joining the lengths 24, 26 of hook and loop material. The segment of cable is therefore quickly and inexpensively camouflaged in the key color.

If a studio decides to change the key color for a scene, the sheathing device 10 can be removed from the segment of cable, flipped over and reformed around that segment of cable. The segment of cable is therefore quickly camouflaged in a second key color, without the use of any tools or the use of any additional materials.

It will be understood that the embodiment of the present invention that is illustrated and described is merely exemplary and that a person skilled in the art can make many variations to that embodiment. For instance, snaps and similar types of mechanical fasteners can be substituted for the hook and loop material described. Likewise, although the colors blue and green are most commonly used in chroma key videography, other colors can be used as key colors. What is important is that the colors on opposite sides of the sheathing device are different and that those colors are acceptable key colors. All such embodiments are intended to be included within the scope of the present invention as defined by the claims.

What is claimed is:

1. A method comprising the steps of:

providing a scene set to be recorded using chroma key videography, wherein said chroma key videography does not record objects having a selected mask key color and wherein said selected mask key color is selected from a group consisting of a first key color and a second key color;

providing a flexible element on said scene sets;

providing a sheath covering for said flexible element, said sheath covering having a length, a first side, and an opposite second side, wherein said first side and said second side extend said length of said sheath covering between two side edges, and wherein said first side of said sheath covering is said first key color and said second side of said sheath covering is said second key color;

choosing said selected mask key color for use during said chroma key videography;

forming said sheath covering into a tubular structure around said flexible element, wherein said tubule structure is formed to have an exterior that corresponds in color to said selected mask key color, therein masking said flexible element in said selected mask key color with said sheath covering.

2. The method according to claim 1, wherein said step of providing a sheath covering includes providing a sheath covering with hook and loop fastening material along said two side edges.

3. The method according to claim 2, wherein said step of forming said sheath covering includes joining said hook and loop fastening material together, therein connecting said two side edges and forming said tubular structure.

4. The method according to claim 1, further including the step of changing said selected mask key color for use during said chroma key videography and reversing said sheath covering so that said exterior of said sheath covering corresponds in color with said selected mask key color.

5. The method according to claim 1, wherein said step of providing a sheath covering includes the substeps of:

providing a first segment of fabric in said first key color;

providing a second segment of fabric in said second key color;

overlaying said first segment of fabric atop said second segment of fabric; and sewing said first segment of fabric to said second segment of fabric, therein forming a two-ply sheath covering.

6. The method according to claim 5, further including the step of sewing a first segment of hook and loop material to said first side of said sheath covering and sewing a second segment of hook and loop material to said second side of said sheath covering.

7. A method comprising the steps of:

providing a scene set to be recorded using chroma key videography, wherein said chroma key videography does not record objects having a selected mask key color, wherein said selected mask key color is selected from a group consisting of a first key color and a second key color, and wherein a cable is present on said scene set that is not said selected mask key color;

providing a masking cover having a first surface and a second surface extending between a first end, a second end, and two side edges, wherein said first surface is said first masking key color and said second surface is said second masking key color;

choosing said selected mask key color for use during said scene set;

providing fasteners along said two side edges for selectively joining said two side edges, therein enabling said masking cover to form a tubular structure having an exterior; and joining said two side edges around said cable, therein enveloping said cable within said tubular structure so that said exterior of said tubular structure corresponds in color to said selected mask key color, therein said masking said cable from said chroma key videography.

8. The method according to claim 7, further including the step of changing said selected mask key color and reversing said masking cover so that said exterior matches said selected mask key cover.

9. The method according to claim 7, wherein said step of providing a masking cover includes the substeps of:

providing a first segment of fabric in said first masking key color;

providing a second segment of fabric in said second masking key color;

overlaying said first segment of fabric atop said second segment of fabric; and sewing said first segment of fabric to said second segment of fabric, therein forming a two-ply masking cover.

10. The method according to claim 9, wherein said step of providing fasteners along includes sewing hook and loop material to said masking cover.

* * * * *